US008475238B2

(12) United States Patent
Choi et al.

(10) Patent No.: US 8,475,238 B2
(45) Date of Patent: Jul. 2, 2013

(54) POLISHING PADS INCLUDING SIDEWALLS AND RELATED POLISHING APPARATUSES

(75) Inventors: Jae-Kwang Choi, Suwon-si (KR); Bo-Un Yoon, Seoul (KR); Myung-Ki Hong, Seoul (KR)

(73) Assignee: Samsung Electronics Co., Ltd. (KR)

( * ) Notice: Subject to any disclaimer, the term of this patent is extended or adjusted under 35 U.S.C. 154(b) by 302 days.

(21) Appl. No.: 12/855,164

(22) Filed: Aug. 12, 2010

(65) Prior Publication Data

US 2011/0039480 A1 Feb. 17, 2011

(30) Foreign Application Priority Data

Aug. 13, 2009 (KR) ..... 10-2009-0074849

(51) Int. Cl.
*B24D 11/00* (2006.01)

(52) U.S. Cl.
USPC ..... 451/527; 451/530

(58) Field of Classification Search
USPC ..... 451/527, 528, 529, 530, 539
See application file for complete search history.

(56) References Cited

U.S. PATENT DOCUMENTS

| | | | | |
|---|---|---|---|---|
| 794,495 | A * | 7/1905 | Gorton | 451/529 |
| 5,014,468 | A * | 5/1991 | Ravipati et al. | 51/295 |
| 5,427,566 | A * | 6/1995 | Landi et al. | 451/526 |
| 5,489,233 | A * | 2/1996 | Cook et al. | 451/41 |
| 5,709,598 | A * | 1/1998 | Nishio et al. | 451/530 |
| 6,354,929 | B1 * | 3/2002 | Adefris et al. | 451/527 |
| 6,422,929 | B1 * | 7/2002 | Jang et al. | 451/296 |
| 6,514,130 | B2 * | 2/2003 | Moore | 451/296 |
| 6,685,540 | B2 * | 2/2004 | Cherian et al. | 451/41 |
| 6,913,519 | B2 * | 7/2005 | Moore | 451/41 |
| 2002/0061723 | A1 * | 5/2002 | Duescher | 451/527 |

FOREIGN PATENT DOCUMENTS

| | | |
|---|---|---|
| JP | 10-235553 | 9/1998 |
| KR | 1020030037158 | 5/2003 |
| KR | 1020070059846 | 6/2007 |

* cited by examiner

*Primary Examiner* — Maurina Rachuba
(74) *Attorney, Agent, or Firm* — Myers Bigel Sibley & Sajovec, P.A.

(57) ABSTRACT

A polishing pad may include a base and a plurality of polishing protrusions on a surface of the base. Each polishing protrusion may include a sidewall defining an opening in a surface of the polishing protrusion opposite the base. In addition, portions of the sidewall opposite the base may define a contact surface.

18 Claims, 4 Drawing Sheets

POLISHING PADS INCLUDING SIDEWALLS AND RELATED POLISHING APPARATUSES

CLAIM OF PRIORITY

This application claims priority under 35 USC §119 to Korean Patent Application No. 10-2009-0074849, filed on Aug. 13, 2009, in the Korean Intellectual Property Office (KIPO), the disclosure of which is hereby incorporated herein by reference in its entirety.

BACKGROUND

1. Field

Examples of embodiments relate to polishing pads and related chemical mechanical polishing apparatuses and methods.

2. Description of the Related Art

A chemical mechanical polishing process may be performed to planarize a wafer surface using a combination of a mechanical polishing effect of an abrasive and a chemical reaction effect of an alkali solution.

Generally, a chemical mechanical polishing apparatus may include a polishing head and a slurry supplying unit. The polishing head may rotate and pressurize a wafer on a polishing pad. The slurry supplying unit may feed a slurry as a polishing solution. The slurry may include the abrasive and acid and/or alkali solutions. When the slurry is fed to the polishing pad, the polishing head may grip and move the wafer to the polishing pad, and then, rotate the wafer that is in contact with the polishing pad. Thus, for example, a semiconductor material layer of the wafer may undergo chemical reactions in the acid and/or alkali solutions and may also be mechanically polished by the abrasive.

A fixed abrasive polishing pad including abrasive particles may be used for the polishing pad. The polishing pad may have polishing protrusions having hexagonal pillar shapes and arranged in a row. The polishing protrusions may include the abrasive particles. Each polishing protrusion may have a concave-shaped top surface.

As a polishing process using the polishing pad proceeds, however, edge portions of top surfaces of the polishing protrusions may wear out. Accordingly, a contact area between a polishing protrusion and the wafer may gradually increase, and thus, polishing characteristics (such as a polishing rate of the wafer, scratching, a polishing profile of the wafer, etc.) may change due to increased contact area. Therefore, it may be difficult to polish a wafer uniformly.

SUMMARY

According to some embodiments, a polishing pad may include a base and a plurality of polishing protrusions on a surface of the base. Each polishing protrusion may include a sidewall defining an opening in a surface of the polishing protrusion opposite the base. Moreover, portions of the sidewall opposite the base may define a contact surface.

Each polishing protrusion may include a plurality of channels through the sidewall providing fluid communication between the opening and an outside of the polishing protrusion. A ratio of a width of the sidewall to half of a greatest width of the opening may be in the range of about 1:8 to about 1:14. The sidewall may have a uniform width around a perimeter of the opening, and/or the contact surface of each polishing pad may be symmetrical with respect to a center point of the respective polishing pad. The sidewall of each polishing pad may be castellated, and/or the sidewall of each polishing protrusion may include abrasive particles therein.

According to some other embodiments, a chemical mechanical polishing apparatus may include a polishing pad, a stage supporting the polishing pad, a polishing head, and a slurry supplier. The polishing pad may include a base and a plurality of polishing protrusions on a surface of the base. Each polishing protrusion may include a sidewall defining an opening in a surface of the polishing protrusion opposite the base, and portions of the sidewall opposite the base may define a contact surface. The polishing head may be configured to hold a wafer so that a surface of the wafer faces the polishing pad, to move the wafer so that the surface of the wafer contacts the polishing pad, and to rotate the wafer so that the surface of the wafer rotates in contact with the polishing pad. The slurry supplier may be configured to feed a slurry between the polishing pad and the wafer.

A transfer unit may be configured to transfer the polishing pad across the stage in a direction parallel with respect to the surface of the wafer, and the transfer unit may be configured to transfer the polishing pad while the wafer rotates in contact with the polishing pad. The transfer unit may include first and second rollers at respective first and second ends of the stage. The first roller may be configured to supply portions of the polishing pad to the stage by unwinding the polishing pad from around the first roller, and a second roller may be configured to remove portions of the polishing pad from the stage by winding the polishing pad around the second roller.

Each polishing protrusion may includes a plurality of channels through the sidewall providing fluid communication of the slurry between the opening and an outside of the polishing protrusion while rotating the wafer in contact with the polishing pad. A ratio of a width of the sidewall to half of a greatest width of the opening may be in the range of about 1:8 to about 1:14. The sidewall may have a uniform width around a perimeter of the opening, and/or the contact surface of each polishing pad may be symmetrical with respect to a center point of the respective polishing pad. The sidewall of each polishing pad may be castellated, and/or the sidewall of each polishing protrusion may include abrasive particles therein.

According to still other embodiments, a method of polishing a wafer may include providing a polishing pad including a base and a plurality of polishing protrusions on a surface of the base. Each polishing protrusion may include a sidewall defining an opening in a surface of the polishing protrusion opposite the base, and portions of the sidewall opposite the base may define a contact surface. The wafer may be rotated so that a surface of the wafer rotates in contact with the polishing pad, and a slurry may be fed between the polishing pad and the wafer.

In addition, the polishing pad may be transferred across the surface of the wafer while rotating the wafer in contact with the polishing pad. Each polishing protrusion may include a plurality of channels through the sidewall providing fluid communication of the slurry between the opening and an outside of the polishing protrusion while rotating the wafer in contact with the polishing pad.

A ratio of a width of the sidewall to half of a greatest width of the opening may be is in the range of about 1:8 to about 1:14. The sidewall may have a uniform width around a perimeter of the opening, and/or the contact surface of each polishing pad may be symmetrical with respect to a center point of the respective polishing pad. The sidewall of each polishing pad may be castellated, and/or the sidewall of each polishing protrusion may include abrasive particles therein.

Examples of embodiments may provide polishing pads to polish a wafer uniformly.

Examples of embodiments may provide a chemical mechanical polishing apparatus having a polishing pad.

According to some examples of embodiments, a polishing pad may include a base and a plurality of polishing protrusions on the base. Each polishing protrusion may include abrasive particles to polish a wafer. Each polishing protrusion may have an opening in the middle of a top surface of the polishing protrusion to define a contact surface with the wafer in an edge portion of the top surface of the polishing protrusion.

In examples of embodiments, each polishing protrusion may have a plurality of channels that connect an opening to an outside of the polishing protrusion.

In examples of embodiments, a ratio of a width of a contact surface and half a width of the opening may be in a range of about 1:8 to about 1:14.

In examples of embodiments, a contact surface between the polishing protrusion and the wafer may have a uniform width along a circumference of the polishing protrusion.

In examples of embodiments, the contact surface between the polishing protrusion and the wafer may have a symmetrical shape with respect to the center point of the polishing protrusion.

According to some examples of embodiments, a chemical mechanical polishing apparatus may include a polishing pad, a stage, a polishing head and a slurry supplier. The polishing pad may include a base and a plurality of polishing protrusions provided on the base. The polishing protrusion may have an opening in the middle of a top surface of the polishing protrusion to define a contact surface with a wafer in an edge portion of the top surface of the polishing protrusion. The polishing pad may include abrasive particles to polish the wafer. The stage may support the polishing pad during the polish of the wafer. The polishing head may grip the wafer such that a to-be-polished surface of the wafer faces the polishing pad, may move the wafer such that the to-be-polished surface of the wafer contacts the polishing pad, and may rotate the wafer during the polish of the wafer. The slurry supplier may feed a slurry into an interspace between the wafer and the polishing pad during the polish of the wafer.

In examples of embodiments, the chemical mechanical polishing apparatus may further include a transfer unit to transfer the polishing pad in a direction parallel with the to-be-polished surface of the wafer such that polishing pads to contact the wafer are determined.

In examples of embodiments, the transfer unit may include a first roller and a second roller. The first roller may be provided at a first end of the stage and may supply the polishing pad to the stage. The second roller may be provided at a second end of the stage and may wind the polishing pad around the second roller after performing the polishing process on the wafer.

According to examples of embodiments, the contact surface of the polishing pad with a wafer may be in at edge portion of the top surface of the polishing protrusion. Even if the polishing protrusion is worn out while polishing the wafer, the contact area of the polishing protrusion with the wafer may be maintained relatively uniformly. Additionally, channels connecting the opening to the outside of the polishing protrusion may be formed at regular intervals in the contact surface of the polishing protrusion. Therefore, the slurry may flow relatively smoothly through the channels.

The contact area of the polishing protrusion with the wafer may be maintained relatively uniformly, and the slurry may flow relatively smoothly through the channels so that the wafer may be planarized relatively uniformly using the polishing pad.

BRIEF DESCRIPTION OF THE DRAWINGS

Examples of embodiments will be more clearly understood from the following detailed description taken in conjunction with the accompanying drawings.

FIG. 1 is a perspective view illustrating a polishing pad in accordance with examples of embodiments;

FIG. 2 is a partially cross-sectional view taken along a line A-A' in FIG. 1;

FIG. 3 is a plan view illustrating another type of an opening in FIG. 1;

FIG. 4 is a perspective view illustrating a polishing pad in accordance with examples of embodiments;

FIG. 5 is a plan view illustrating a polishing pad in FIG. 4;

FIG. 6 is a cross-sectional view illustrating a chemical mechanical polishing apparatus in accordance with examples of embodiments.

DETAILED DESCRIPTION OF EMBODIMENTS

Figure 1:
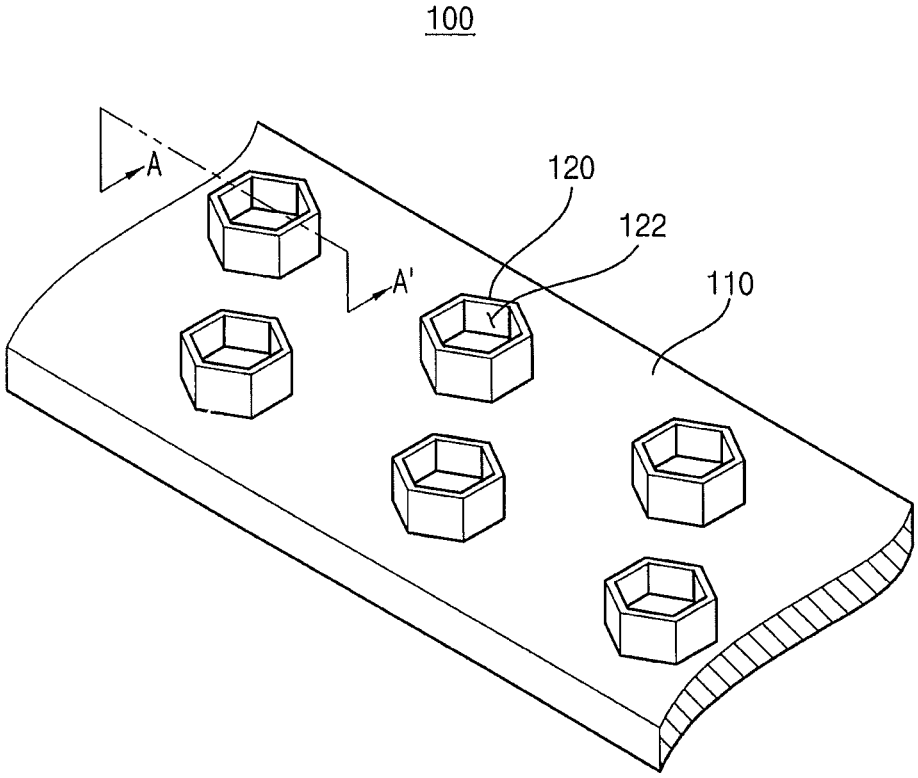
FIGS. 1 to 6 represent non-limiting, examples of embodiments as described herein.

Various examples of embodiments will be described more fully hereinafter with reference to the accompanying drawings, in which some examples of embodiments are shown. Present inventive concepts may, however, be embodied in many different forms and should not be construed as limited to the examples of embodiments set forth herein. Rather, these examples of embodiments are provided so that this description will be thorough and complete, and will fully convey the scope of present inventive concepts to those skilled in the art. In the drawings, sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concepts.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular examples of embodiments only and is not intended to be limiting of present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, however do not preclude the presence or addition of one or more other features, integers, steps, operations, elements, components, and/or groups thereof.

Examples of embodiments are described herein with reference to cross-sectional illustrations that are schematic illustrations of idealized examples of embodiments (and intermediate structures). As such, variations from the shapes of the illustrations as a result, for example, of manufacturing techniques and/or tolerances, are to be expected. Thus, examples of embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of present inventive concepts.

Unless otherwise defined, all terms (including technical and scientific terms) used herein have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
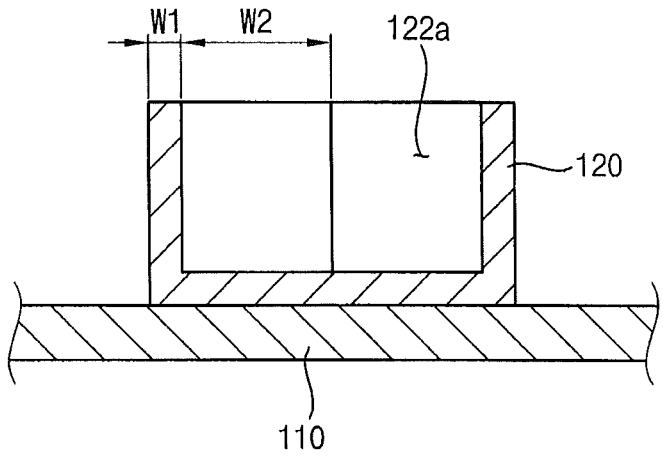

FIG. 1 is a perspective view illustrating a polishing pad in accordance with an example embodiment. FIG. 2 is a cross-sectional view taken along the line A-A' in FIG. 1.

Referring to FIGS. 1 and 2, a polishing pad 100 provided to polish a wafer may include a base 110 and a plurality of polishing protrusions 120 provided on the base 110.

The base 110 may have a shape of a flat sheet. The base 110 may include a polymer having excellent strength, flexibility and durability. For example, the polishing pad 110 may be adapted for a rotary type chemical mechanical polishing apparatus. The polishing pad 110 may bear against at least two rollers of the apparatus. The polishing pad 110 may be unwound from one roller and may be wound on another roller so that the chemical mechanical polishing apparatus may perform a polishing process. The two rollers may create a tensile force in the polishing pad 110 during winding and the base 110 may have enough elasticity to maintain the tensile force.

The base 110 may have a single layer structure. Alternatively, the base 110 may have a multi layer structure including a material suitable for required characteristics, such as strength, flexibility and durability. For example, the base 110 may include an upper layer and a lower layer. The upper layer may have a first strength, and the lower layer may have a second strength lower than the first strength. The upper layer may increase the entire strength of the base 110 and the lower layer may increase flexibility of the base 110 such that the base 110 can be flexibly wound around the rollers.

Examples of materials that may be included in the base 110 may be polyurethane, polyester, polyether, epoxy, polyimide, polycarbonate, polyethylene, polypropylene, latex, nitrile rubber, isoprene rubber, etc. In this embodiment, the base 110 may include polyurethane.

The polishing protrusions 120 may be provided on the base 110. Each polishing protrusion 120 may have a pillar shape with a bottom surface (at a proximal or fixed end) attached to base 110. The polishing protrusions 120 may be arranged at regular intervals across a width and/or length of the base 110. For example, each polishing protrusion 120 may have a cylindrical shape or a polygonal pillar shape such as a hexagonal pillar. Moreover, outer surfaces of the polishing protrusions 120 may define sidewalls.

Each polishing protrusion 120 may have an opening 122 (also referred to as a cavity) in an upper portion or top surface thereof. The opening 122 may be formed in the middle region of the polishing protrusions 120. A width of the opening 122 may be uniform along the extending direction of the opening 122. A depth of the opening 122 may be less than a height of the polishing protrusion 120. That is, the polishing protrusion 120 may have a hollow pillar shape having an opened top surface. Accordingly, since a contact area between the polishing protrusion 120 and the base 110 is relatively wide, separation of polishing protrusions 120 from base 110 may be reduced.

Alternatively, the depth of the opening 122 may be substantially identical to the height of the polishing protrusion 120. That is, each polishing protrusion 120 may have a hollow pillar shape having an opened top surface and an opened bottom surface. Stated in other words, the depth of the opening 120 may extend fully to the proximal surface of the base 110.

Each opening 122 may be formed in the middle of the upper portion of a respective polishing protrusion 120 to define a contact surface with a wafer at an edge portion of the top surface (at a distal or free end or free end) of the polishing protrusion 120 except for the opening 122. Accordingly, the contact surface of the polishing protrusion 120 may have an annular shape.

The opening 122 may have a shape corresponding to an outer shape of the polishing protrusion 120 as shown in FIG. 1. For example, if the polishing protrusion 120 has a cylindrical shape, a shape of the opening 122 in plan view may have a circular shape. If the polishing protrusion 120 has a hexagonal pillar shape, the shape of the opening 122 may be a hexagonal shape in plan view. Accordingly, a width (W1) of the contact surface of the polishing protrusion 120 with a wafer may be relatively uniform along the circumference of the polishing protrusion 120 opposite the base 110. Width (W1) may also define a width of the polishing protrusion sidewall.

Figure 3:
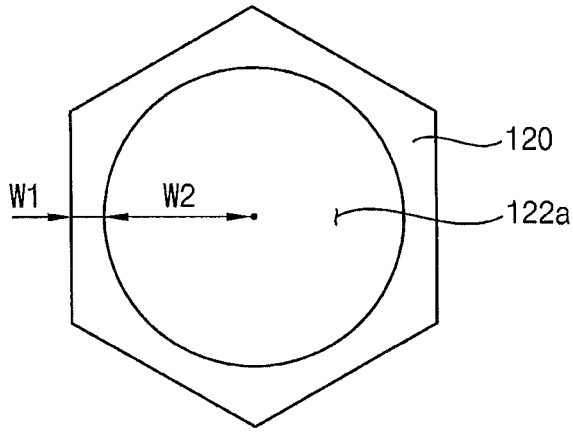

FIG. 3 is a plan view illustrating another type of the opening in FIG. 1.

Referring to FIG. 3, the shape of the opening 122 may be different from the shape of the polishing protrusion 120. For example, in a case in which the polishing protrusion 120 has a hexagonal pillar shape, the shape of the opening 122 may be a circular shape in plan view. Alternatively, in a case in which the polishing protrusion 120 has a cylindrical shape, the opening 122 may be a polygonal shape. Accordingly, the width (W1) of the contact surface of the polishing protrusion 120 in contact with the wafer may be variable along the circumference of the polishing protrusion 120. In this case, the contact surface of the polishing protrusion 120 with the wafer may have a symmetrical shape with respect to the center of the polishing protrusion 120.

Since the opening 122 is uniform along its entire depth, that is, the width (W1) of the contact surface of the polishing protrusion 120 is uniform along from the top surface to the bottom surface thereof, although the contact surface of the polishing protrusion 120 may be removed due to abrasion or wear during a polishing process, the width (W1) of the contact surface of the polishing protrusion 120 may be maintained to be uniform during the polishing process. Accordingly, the polishing characteristics (such as a polishing rate of the wafer, scratching, a polishing profile of the wafer, etc.) may be maintained during the polishing process. Therefore, the wafer may be planarized relatively uniformly using the polishing pad 100.

When the ratio of the width (W1) of the contact surface and the half width (W2) of the opening 122 is less than about 1:8, the width of the contact surface may be relatively wide. Accordingly, the polishing protrusion 120 may not be significantly damaged during the polish of the wafer. However, in this case, the outer portion of the contact surface may be mainly used to polish the wafer while the inner portion of the contact surface may be rarely used. Thus, the contact surface of the polishing protrusion 120 contacting with the wafer may be changed as the polishing process proceeds, and the polishing characteristics of the wafer may be changed accordingly. Therefore, polishing the wafer uniformly by using the polishing pad 100 may be difficult.

When the ratio of the width (W1) of the contact surface and the half width (W2) of the opening 122 is more than about 1:14, the width of the contact surface may be relatively narrow. Accordingly, the contact surface of the polishing protrusion 120 contacting with the wafer may not be changed, and the polishing characteristics of the wafer may not be changed accordingly. However, the polishing protrusions 120 may be broken easily during the polish of the wafer due to the narrow width (W1) of the contact surface.

Therefore, the ratio of the width (W1) of the contact surface and the half width (W2) of the opening 122 may be in a range of about 1:8 to 1:14 to reduce damage to polishing protrusion 120. In this case, the width (W1) of the contact surface with the wafer may be uniform or variable along the circumference of the polishing protrusion 120.

The polishing protrusion 120 may be formed using a material having thermoplasticity, thermosetting, and/or ultraviolet ray setting, and/or precursors thereof. For example, the polishing protrusion 120 may include polyurethane, polypropylene, polyacryl, polyethylene, block co-polymer, etc. Alternatively, the polishing protrusion 120 may include an active hydrogen compound as a precursor of a polyurethane and an isocyanate compound as a polymerization catalyst, etc.

Additionally, the polishing protrusions 120 may include abrasive particles polishing the wafer mechanically. The abrasive particles may include silica ($SiO_2$), ceria ($CeO_2$), and alumina ($Al_2O_3$), etc. These abrasive particles may be used alone or in combinations thereof.

The contact surface of the polishing pad 100 provided to contact the wafer may be formed in the edge of the top surface of the polishing protrusion 120. Even if the polishing protrusion 120 is worn out during the polish of the wafer, the contact surface may be maintained relatively uniformly. Therefore, the wafer may be planarized relatively uniformly using the polishing pad 100.

Figure 4:
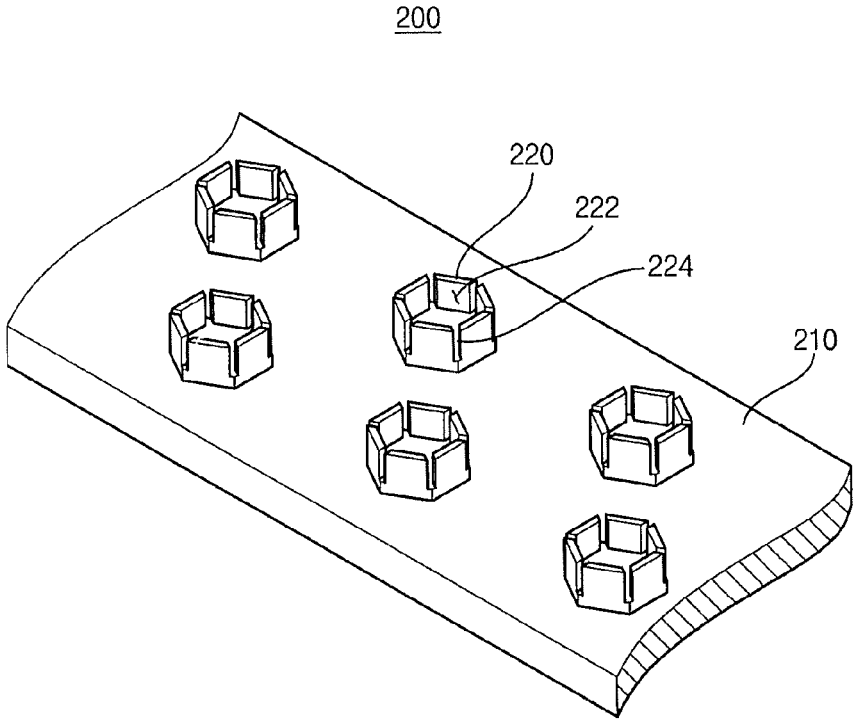
Figure 5:
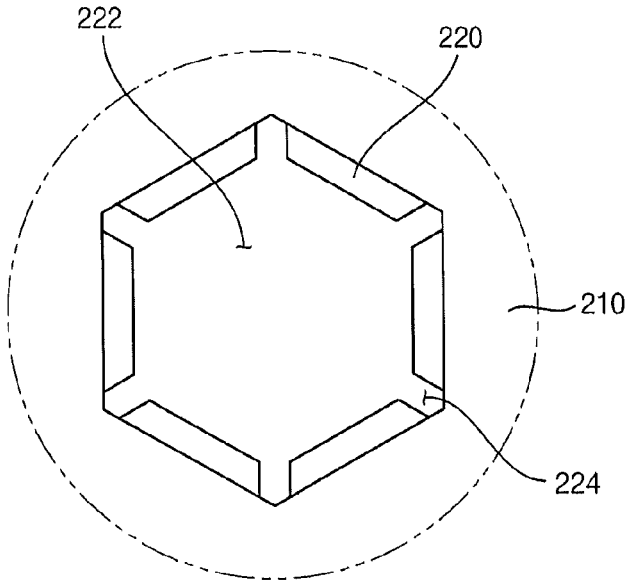

FIG. 4 is a perspective view illustrating a polishing pad in accordance with other examples of embodiments. FIG. 5 is a plan view illustrating the polishing pad of FIG. 4.

Referring to FIGS. 4 and 5, a polishing pad 200 may be provided to polish a wafer and may include a base 210 and a plurality of polishing protrusions 220 provided on the base 210.

The base 210 and the polishing protrusions 220 of FIGS. 4 and 5 may be substantially the same as in embodiments described with reference to FIGS. 1 to 3 except that polishing protrusions 220 may have channels 224 (also referred to as slots and/or castellations), and thus further explanations with respect to unchanged elements will be omitted for the sake of conciseness.

The channels 224 may be formed at regular intervals in contact surfaces of the polishing protrusions 220. The channels 224 may connect an opening 222 to an outside of the polishing protrusion 220. Therefore, the channels 224 may reduce congestion of slurry applied to the polishing pad 200 to polish the wafer. Therefore, the slurry may flow relatively smoothly through the channels 224. That is, the slurry may flow from the outside of a polishing protrusion 220 into the opening 222 through the channels 224, and the slurry may flow from the opening 222 to the outside of a polishing protrusion 220 through the channels 224.

The channels 224 may allow the slurry to flow relatively smoothly across the polishing pad 200. Accordingly, the wafer may be planarized relatively uniformly using the polishing pad 200.

Figure 6:
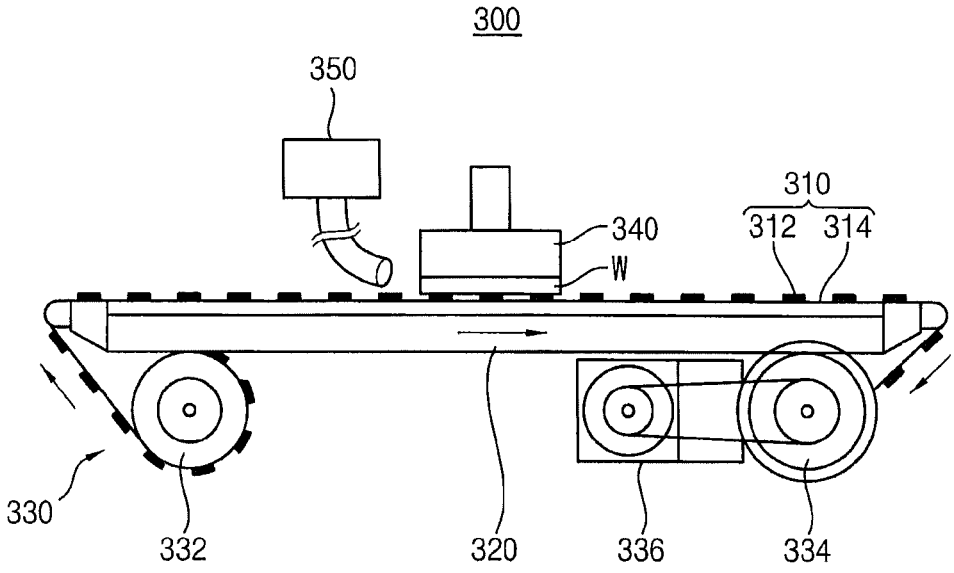

FIG. 6 is a cross-sectional view illustrating a chemical mechanical polishing apparatus in accordance with examples of embodiments.

Referring to FIG. 6, a chemical mechanical polishing apparatus 300 may be provided to polish a wafer (W) uniformly so that the wafer (W) may be planarized. The chemical mechanical polishing apparatus 300 may include a polishing pad 310, a stage 320, a transfer unit 330, a polishing head 340 and a slurry supplier 350.

The polishing pad 310 may include a base 314 and polishing protrusions 312. A polishing pad 100 described with reference to FIGS. 1 to 3 may be used as the polishing pad 310. Therefore, explanation of the polishing pad 310 may be substantially the same as that of the polishing pad 100 described with FIGS. 1 to 3, and thus further explanation of the polishing pad 310 will be omitted.

In addition, a polishing pad 200 described with respect to FIG. 4 and FIG. 5 may be used as the polishing pad 310. Therefore, explanation of the polishing pad 310 may be substantially the same as that of the polishing pad 200 described with reference to FIGS. 4 and 5, and thus further explanation of the polishing pad 310 will be omitted.

The stage 320 may support the polishing pad 310. For example, the stage 320 may support a lower surface of the base 314 opposite to an upper surface where the polishing protrusions 312 are provided.

The transfer unit 330 may be configured to deliver the polishing pad 310 on the stage 320 and may include a first roller 332, a second roller 334 and a motor 336.

The first roller 332 may be provided rotatably at a first end of the stage 320. The polishing pad 310 may be wound around the first roller 332, and the first roller 332 may supply the polishing pad 310 to the stage 320.

The second roller 334 may be provided rotatably in a second end of the stage 320. The polishing pad 310 may be transferred from the stage 320 after performing the polishing process with respect to the wafer (W) to the second roller 334, and then, may be wound around the second roller 334.

The motor 336 may be connected to the second roller 334 to rotate the second roller 334 such that the polishing pad 310 is wound around the second roller 334. As the second roller 334 rotates, the polishing pad 310 is supplied from the first roller 332 to the stage 320.

Alternatively, the motor 336 may be connected to the first roller 332 and the second roller 334 respectively, to rotate the first roller 332 and the second roller 334 respectively.

As the polishing pad 310 is transferred on the stage 320 by the transfer unit 330, some of the polishing pads 310 to contact the wafer (W) may be determined.

The polishing head 340 may be movable in a direction perpendicular to the upper surface of the stage 320. A bottom surface of the polishing head 340 may be subjected to vacuum pressure such that the wafer (W) is fixed on the polishing head. A to-be-polished surface of the wafer (W) may face the polishing pad 310 on the stage 320. In particular, the polishing head 340 may move the wafer to the upper surface of the polishing pad 310 such that the to-be-polished surface of the wafer (W) contacts the surface of the polishing pad 310. The polishing head 340 may rotate the wafer (W) that is in contact with the polishing pad 310, to improve the polishing efficiency of the wafer (W).

The slurry supplier 350 may be disposed over the stage 320. For example, the slurry supplier 350 may be positioned in front of the polishing head 340 toward the transfer direction. The slurry supplier 350 may feed a slurry into the interspace between the wafer (W) and the polishing pad 310 during the polish of the wafer (W). Particularly, the slurry may be dispensed on the top surface of the base 314 and in the openings of the polishing protrusions 312, and be fed into the interspace between the wafer (W) and the polishing protrusions 312.

In a case in which the polishing pad in FIGS. 4 and 5 is used for the polishing pad 310, the openings of the polishing protrusions 312 may not be congested with the slurry so that the slurry may smoothly flow through the channels. Accordingly, the slurry may be fed uniformly into the interspace between the wafer (W) and the polishing pad 310 during the polish of the wafer (W).

The chemical mechanical polishing process may be performed on the to-be-polished surface of the wafer (W) using friction against the polishing protrusions 312 of the polishing pad 310 as well as reaction with the slurry.

The chemical mechanical polishing apparatus 300 may uniformly polish the to-be-polished surface of the wafer (W) chemically and mechanically using the polishing pad 310.

Hereinafter, operations of the chemical mechanical polishing apparatus 300 will be described.

The polishing pad 310 may be supplied to the stage 320 by the rotation of the first roller 332.

Next, the wafer (W) may be fixed on the bottom surface of the polishing head 340 by vacuum pressure. The to-be-polished surface of the wafer (W) may face the polishing pad 310 on the stage 320. Then, the polishing head 340 may move the wafer (W) to the upper surface of the polishing pad 310 such that the to-be-polished surface of the wafer (W) contacts the surface of the polishing pad 310. The polishing head 340 may rotate the wafer (W) that is in contact with the polishing pad 310, to improve the polishing efficiency of the wafer (W).

The slurry supplier 350 may feed a slurry into the interspace between the wafer (W) and the polishing pad 310 during the polish of the wafer (W). Particularly, the slurry may be dispensed on the top surface of the base 314 and in the openings of the polishing protrusions 312, and be fed into the interspace between the wafer (W) and the polishing protrusions 312.

The chemical mechanical polishing process may be performed on the to-be-polished surface of the wafer (W) using friction against the polishing protrusions 314 of the polishing pad 310 as well as reaction with the slurry.

When the polishing process for the wafer (W) is completed, the polishing head 340 may be spaced apart from the polishing pad 310. Additionally, the slurry supplier 350 may stop supplying the slurry. The polishing pad 310 may be transferred from the stage 320 after performing the polishing process with respect to the wafer (W) to the second roller 334, and then, may be wound around the second roller 334. The polishing pad 310 wound around the second roller 334 may be scraped.

Through the above-mentioned operations, the chemical mechanical polishing apparatus 300 may polish uniformly the wafer (W) mechanically and chemically.

According to the examples of embodiments discussed herein, a contact surface of the polishing pad to contact the wafer may be formed at the edge of the top surface of the polishing protrusion. Accordingly, even if the polishing protrusion 120 is worn out during the polish of the wafer, the contact surface may be maintained uniformly. Additionally, the polishing protrusion may have channels connecting the opening to the outside of the polishing protrusion. Therefore, the channels may allow the slurry to smoothly flow across the polishing pad. Accordingly, since the contact surface of the polishing pad to contact the wafer may be maintained uniformly and the slurry may flow smoothly, the wafer may be planarized uniformly using the polishing pad.

By using the polishing pad for the chemical mechanical polishing apparatus, the wafer may be planarized uniformly, and reliability and productivity of the semiconductor device may be increased.

The foregoing is illustrative of examples of embodiments and is not to be construed as limiting thereof. Although a few examples of embodiments have been described, those skilled in the art will readily appreciate that many modifications are possible in the examples of embodiments without materially departing from the novel teachings and advantages of embodiments of the present inventive concepts. Accordingly, all such modifications are intended to be included within the scope of the present inventive concepts as defined in the claims. In the claims, means-plus-function clauses are intended to cover the structures described herein as performing the recited function and not only structural equivalents but also equivalent structures. Therefore, it is to be understood that the foregoing is illustrative of various examples of embodiments and is not to be construed as limited to the specific examples of embodiments disclosed, and that modifications to the disclosed examples of embodiments, as well as other examples of embodiments, are intended to be included within the scope of the appended claims.

What is claimed is:

1. A polishing pad comprising:

a base; and a plurality of separate and spaced apart polishing protrusions on a surface of the base, wherein the polishing protrusions are spaced apart on the surface of the base, wherein each polishing protrusion includes a sidewall defining an opening in a surface of the polishing protrusion opposite the base, and wherein portions of the sidewall opposite the base define a contact surface;

wherein each polishing protrusion includes a plurality of channels through the sidewall providing fluid communication between the opening and an outside of the polishing protrusion wherein depths of the channels are less than a depth of the opening.

2. The polishing pad according to claim 1 wherein a ratio of a width of the sidewall to half of a greatest width of the opening is in the range of about 1:8 to about 1:14.

3. The polishing pad according to claim 2 wherein the sidewall has a uniform width around a perimeter of the opening.

4. The polishing pad according to claim 2 wherein the contact surface of each polishing protrusion is symmetrical with respect to a center point of the respective polishing protrusion.

5. A polishing pad comprising:

a base; and a plurality of separate and spaced apart polishing protrusions on a surface of the base, wherein the polishing protrusions are spaced apart on the surface of the base, wherein each polishing protrusion includes a sidewall defining an opening in a surface of the polishing protrusion opposite the base, and wherein portions of the sidewall opposite the base define a contact surface, wherein the sidewall of each polishing protrusion is castellated, and wherein a depth of each castellation is less than a depth of the opening in the surface of the polishing protrusion.

6. The polishing pad according to claim 1 wherein the sidewall of each polishing protrusion includes abrasive particles therein.

7. A chemical mechanical polishing apparatus comprising:

a polishing pad including a base and a plurality of separate and spaced apart polishing protrusions on a surface of the base, wherein the polishing protrusions are spaced apart on the surface of the base, wherein each polishing protrusion includes a sidewall defining an opening in a surface of the polishing protrusion opposite the base, and wherein portions of the sidewall opposite the base define a contact surface;

a stage supporting the polishing pad;

a polishing head configured to hold a wafer so that a surface of the wafer faces the polishing pad, to move the wafer so that the surface of the wafer contacts the polishing pad, and to rotate the wafer so that the surface of the wafer rotates in contact with the polishing pad; and a slurry supplier configured to feed a slurry between the polishing pad and the wafer;

wherein each polishing protrusion includes a plurality of channels through the sidewall providing fluid communication of the slurry between the opening and an outside of the polishing protrusion while rotating the wafer in contact with the polishing pad wherein depths of the channels are less than a depth of the opening.

8. The chemical mechanical polishing apparatus according to claim 7, further comprising:

a transfer unit configured to transfer the polishing pad across the stage in a direction parallel with respect to the surface of the wafer.

9. The chemical mechanical polishing apparatus according to claim 8 wherein the transfer unit includes a first roller at a first end of the stage configured to supply portions of the polishing pad to the stage by unwinding the polishing pad from around the first roller, and a second roller at a second end of the stage configured to remove portions of the polishing pad from the stage by winding the polishing pad around the second roller.

10. The chemical mechanical polishing apparatus according to claim 7 wherein a ratio of a width of the sidewall to half of a greatest width of the opening is in the range of about 1:8 to about 1:14.

11. The chemical mechanical polishing apparatus according to claim 10 wherein the sidewall has a uniform width around a perimeter of the opening.

12. The chemical mechanical polishing apparatus according to claim 10 wherein the contact surface of each polishing protrusion is symmetrical with respect to a center point of the respective polishing protrusion.

13. A chemical mechanical polishing apparatus comprising:

a polishing pad including a base and a plurality of separate and spaced apart polishing protrusions on a surface of the base, wherein the polishing protrusions are spaced apart on the surface of the base, wherein each polishing protrusion includes a sidewall defining an opening in a surface of the polishing protrusion opposite the base, and wherein portions of the sidewall opposite the base define a contact surface;

a stage supporting the polishing pad;

a polishing head configured to hold a wafer so that a surface of the wafer faces the polishing pad, to move the wafer so that the surface of the wafer contacts the polishing pad, and to rotate the wafer so that the surface of the wafer rotates in contact with the polishing pad; and a slurry supplier configured to feed a slurry between the polishing pad and the wafer;

wherein the sidewall of each polishing protrusion is castellated, and wherein a depth of each castellation is less than a depth of the opening in the surface of the polishing protrusion.

14. The chemical mechanical polishing apparatus according to claim 7 wherein the sidewall of each polishing protrusion includes abrasive particles therein.

15. The polishing pad according to claim 1 wherein a depth of the opening in the surface of each of the separate and spaced apart polishing protrusions is less than a height of the sidewall outside the opening.

16. The polishing pad according to claim 1 wherein the sidewall of each polishing protrusion surrounds a portion of the opening in the surface of the polishing protrusion.

17. The polishing pad according to claim 1 wherein each of the plurality of separate and spaced apart polishing protrusions defines a same shape.

18. The polishing pad according to claim 17 wherein the same shape is cylindrical or polygonal.

* * * * *